United States Patent [19]

Gater et al.

[11] Patent Number: 4,672,829

[45] Date of Patent: Jun. 16, 1987

[54] DOORLATCH KNOB ASSEMBLY HAVING FRONT END LOADING

[75] Inventors: Arnold C. Gater, Anaheim; Thomas S. S. Hu, Corona, both of Calif.

[73] Assignee: Kwikset Corporation, Anaheim, Calif.

[21] Appl. No.: 802,681

[22] Filed: Nov. 29, 1985

Related U.S. Application Data

[62] Division of Ser. No. 652,209, Sep. 20, 1984, Pat. No. 4,631,944.

[51] Int. Cl.[4] ..... E05B 13/10

[52] U.S. Cl. ..... 70/472; 70/224; 70/369

[58] Field of Search ..... 70/224, 367, 369, 368, 70/DIG. 31, DIG. 39, 472

[56] References Cited

U.S. PATENT DOCUMENTS

| | | | |
|---|---|---|---|
| 2,007,350 | 7/1935 | Schlage | 70/224 |
| 2,008,662 | 7/1935 | Bechert | 70/224 |
| 3,541,820 | 11/1970 | Best | 70/369 |
| 4,320,637 | 3/1982 | Wu | 70/224 |

*Primary Examiner*—Robert L. Wolfe

*Attorney, Agent, or Firm*—Barry E. Deutsch

[57] ABSTRACT

The doorlatch may have an exterior free knob rotation which is in the knob collar and is tied through cam means for non-engagement or engagement to drive the latch bolt. If the doorlatch has an exterior key operated lock, the cam means may be shifted by that lock for driving the latch. The cam means may also be shifted by an interior control, such as a turn button of an interior knob. Various combinations of exterior knobs with or without key locks and interior knobs may be provided, including the freely rotatable mechanism as desired. The front end loading may include a cylinder with plug assembly for the doorlatch which may have the plug rotated 180 degrees out of phase with the cylinder, the assembly then inserted and the plug rotated back to normal. A flange is provided beyond the lock cylinder on the plug which engages behind an inward depression for controlling the proper rotation during and after assembly. During assembly and removal of the lock cylinder and plug, a torque blade tying the lock with the remainder of the doorlatch must be temporarily axially disengaged either by a long cylinder removal key inserted during assembly or an operable connection to the interior thumb bar.

6 Claims, 23 Drawing Figures

DOORLATCH KNOB ASSEMBLY HAVING FRONT END LOADING

CROSS-REFERENCE TO RELATED APPLICATION

This application is a division of our co-pending Application, Ser. No. 652,209, filed Sept. 20, 1984 and now U.S. Pat. No. 4,631,944, entitled "KNOB ASSEMBLY FOR DOORLATCHES INCLUDING FREE KNOB ROTATION AND FRONT END LOADING."

BACKGROUND OF THE INVENTION

This invention relates to a knob assembly for doorlatches and, more particularly, to such an assembly having an improved free knob rotation which freely rotates when locked, or an improved front end loading which permits simple lock changing, or both. In the improved free knob rotation, the knob will rotate freely when locked and will become engaged in the normal manner when positioned for operation. Furthermore, the change between the lock and operating modes can be from an exterior lock, if provided, or an interior operator of one type or another, with or without an exterior lock. Still in addition, both the improved free knob rotation and the improved front end loading are of simplified forms over those previously provided and are constructed properly operable over a long period of useful life.

Various types of free knob rotations have heretofore been provided incorporated in various of the prior doorlatches. Basically, all of the free knob rotations have been similarly operable. In the locked position, the mechanism for the free knob rotation is set to permit the knob to rotate freely so that it does not actuate the particular latch construction, thereby providing increased safety. When, however, the free knob rotation is set to an operable position, motion is transmitted through the knob into the latch construction for operating the same in the usual manner. Such free knob rotation mechanisms may operate totally alone without a lock being involved or may operate in conjunction with a lock so as to provide a second locking means in addition to the lock.

As far as the various constructions of free knob rotations are concerned, all of the prior constructions have been quite complicated to fabricate and assemble. Even so, the prior constructions have not always afforded positive operation as far as many are concerned and, particularly, over prolong period of use. One basic difficulty is that the entire structure must be of relatively small size in order to fit the size limitations of the latch constructions in doors. The more sophisticated the construction of free knob rotation is concerned, the small size requires increased precision of workmanship resulting in a relatively complex and expensive construction as far as the prior constructions are concerned.

In addition, the provision of the front end loading lock mechanisms have suffered from the same disabilities. In this case, the operator mounting the lock, such as a knob, is constructed so that the lock may be removed and replaced directly from the knob without disassembly of other parts of the doorlatch. The lock is formed as a cylinder and plug assembly so that the unitary lock is inserted and engaged or disengaged and removed relatively expeditiously.

The major difficulty with the prior constructions has, again, been involved with a relatively small size, yet of sufficient strength to suit the particular purpose involved with doorlatch constructions. The engagement means between the lock unit and knob or other type of operator have resulted in relatively complex constructions, all between the lock unit and knob. The result is that the overall constructions have been quite complicated in assembly and expensive to produce.

OBJECTS AND SUMMARY OF THE INVENTION

It is, therefore, an object of this invention to provide a knob assembly for doorlatches wherein the knob assembly may be improved by having an improved freely rotatable knob construction preferably mounted in the exterior or outer knob assembly thereof and which is freely rotatable when the doorlatch construction is locked and is drivingly operable when the doorlatch is unlocked. Furthermore, if the particular doorlatch assembly also includes a lock, the combination of the lock and the freely rotatable knob provides double safety against unauthorized manipulation. Still further, if the doorlatch construction is of the even more complex type having both the exterior or outside and interior or inside knobs provided with keyed locks therefor, the outer knob may have the only freely rotatable knob construction, or both the outside and inside knobs may have separate freely rotatable knob constructions, all dependent on the particular requirements.

It is a further object of this invention to provide a knob assembly for doorlatches of the foregoing type wherein the improved freely rotatable knob construction is of a marked simplicity over the prior constructions and is operable over a long period of useful life, as positively required in latch security to guard against unauthorized manipulation. In the preferred form, the particular knob having the freely rotatable knob construction is formed with an outer shell which terminates inwardly at a mounting collar and is mounted thereby inwardly within the doorlatch construction. Radially inwardly is mounted a cylindrical cam slideably mounting a locking slide with engagement arm, the locking slide moving the engagement arm into engagement in a notch of the knobshell collar or removing the same therefrom. Thus, the knobshell may be disengaged for free rotation of the knobshell or engaged for driving rotation of the knobshell, all in a relatively simple manner.

It is a still further object of this invention to provide a knob assembly for doorlatches wherein the knob assembly may be improved by a unique front end loading construction for changing the lock cylinder and plug quickly and simply, without altering the remainder of the doorlatch construction. In a preferred embodiment thereof, starting from the lock cylinder and plug being removed and a different lock cylinder and lock ready for insertion at the front surface of the knob, a key is used and the plug is first turned 180 degrees out of phase with the cylinder. With this out-of-phase condition, the cylinder and plug are inserted as a unitary member into the knob housing. Thereafter, the key is used to turn the plug 180 degrees back to normal with respect to the cylinder, and the cylinder and plug are now ready for usual operation. Again, in the preferred embodiment, a torque blade is required to be moved axially from and retained out of engagement with the lock plug during insertion and rotation of the lock plug relative to the cylinder. This torque blade may be so positioned either by a special long cylinder removal key or by movement of certain other portions of the doorlatch structure, all of which adds to the efficiency and simplicity of the structure. The removal of the lock cylinder and plug unit is merely exactly opposite of the insertion procedure.

It is still another object of this invention to provide a knob assembly for doorlatches which, in the preferred form, includes both of the unique freely rotatable knob construction and the unique front end loading lock construction, with one operating completely separately from the other. Each is simplified and despite the extremely positive operation for performing its particular function, each is capable of mounting in its required space operably connected in its particular unique form. Thus, all of the many various forms may be considered and used as required, all with maximum simplicity and for a long period of useful life.

Other objects and advantages of the invention will be apparent from the following specification and the accompanying drawings which are for the purpose of illustration only.

DESCRIPTION OF THE BEST EMBODIMENT CONTEMPLATED

Figure 1:
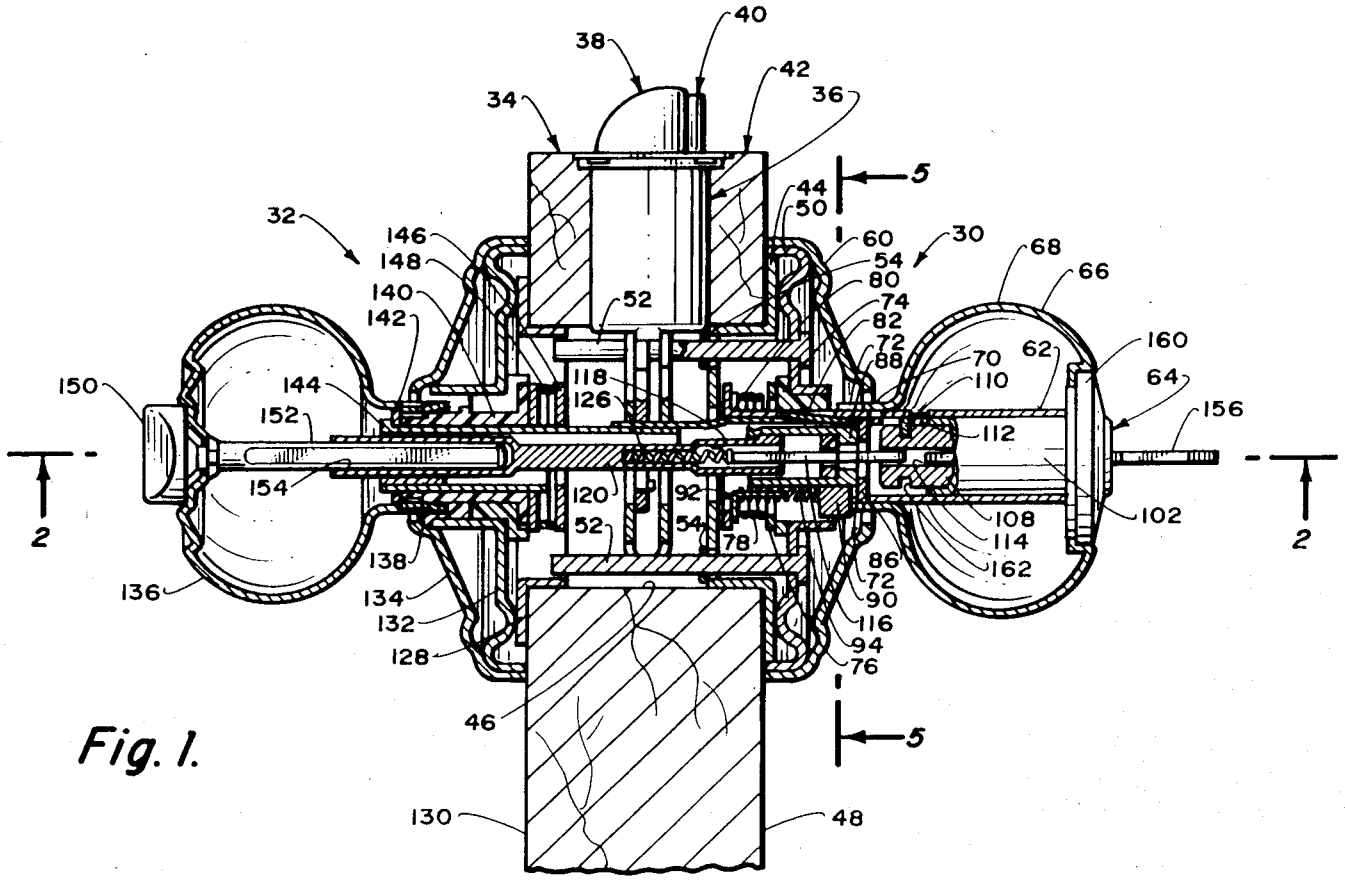
FIG. 1 is a horizontal sectional view of an embodiment of knob assembly for doorlatches including free knob rotation and front end loading according to the principles of the present invention, the construction being mounted in a door and in the unlocked position.

Referring to the drawings, a preferred embodiment of the knob assembly for doorlatches is illustrated therein and will hereinafter be explained in detail. It is pointed out, however, that the present embodiment of knob assembly incorporating the inventions of the present application is merely one form thereof and that various portions or all of the inventive concepts may be incorporated in different forms of knob assembly, the same to be explained further later and to be included in the principles of the present invention. Furthermore, except as pointed out in detail later, all of the elements and parts may be formed using standard materials and manufacturing procedures, and using standard skills of workmanship.

The drawings herein depict the overall knob assembly for doorlatches and inventive principles relating to both freely rotatable knob construction and front-end loading for lock cylinders and plugs. The freely rotatable knob construction is operable for providing, say, the exterior knob freely rotatable when the exterior knob is locked and fully actionable for operating the latch when the exterior knob is unlocked. The front-end loading for the lock cylinder and plug, the unitary lock, is provided to permit the unitary locks freely removable and replaceable from the front of the particular knob or the like, and even though once properly placed in a particular knob, they are extremely difficult to remove without proper keys and procedure.

First, as it primarily relates to the freely rotatable knob construction, and referring to FIGS. 1 through 5 and 7 through 16, the preferred embodiment shown includes an exterior or outer operating device generally indicated at 30 and an interior or inner operating device generally indicated at 32, both of which are mounted in usual manner on a door generally indicated at 34. Either of the exterior or interior operating devices 30 or 32 are mounted for driving a latch driving mechanism generally indicated at 36 within the door 34 to move a latch bolt generally indicated at 38 and an auxiliary deadbolt generally indicated at 40 from extended to retracted and from retracted to extended positions at a door edge generally indicated at 42, again, all in usual manner. As pointed out, the principles of the present invention relate to the exterior and interior operating devices 30 and 32 so that the latch driving mechanism 36, and the latch bolt and auxiliary deadbolt 38 and 40 may be of any usual constructions adaptable for satisfying the combinations.

The exterior or outer operating device 30 includes a reinforcing collar 44 which is received partially within a door opening 46, as well as extending outwardly along the door outside face 48. The reinforcing collar 44 is, in turn, telescoped outwardly by the liner 50. Liner 50 has spaced locators 52 which have retaining rings 54 and extend through the latch driving mechanism 36, as well as screw stems 56 which engage with screws 58 extending from the interior operating device 32 and form the main mount for the two exterior and interior operating devices 30 and 32 within the door opening 46. As particularly seen in FIGS. 1 and 2, although partially shown in other views, a rosette 60 telescopes over the liner 50 and completes the outer portion of the exterior operating device 30 as far as the door outside face 48 is concerned.

Extending centrally through the liner 50 and the rosette 60 spaced inwardly therefrom, and extending both inwardly and outwardly thereof, is a cylinder retaining sleeve 62 which at its outer end portion internally mounts a lock assembly generally indicated at 64 and discussed more completely below. Outwardly telescoping the outer end portion of the cylinder retaining sleeve 62 is an exterior or outer knob 66 which at its outer end telescopes with the lock assembly 64, but is rotatable relative thereto. Knob 66 has an outer shell 68 which terminates toward the door opening 46 in a knob collar 70 spaced inwardly a determined distance beyond the rosette 60 and along the outer surface of the cylinder retaining sleeve 62. The knob collar 70 has diametrically opposed engagement notches 72 which extend from just inwardly of the rosette 60 and opening inwardly at the inner end of these engagement notches. Thus, without engagement at one of the engagement notches 72, the exterior knob 66 is freely rotatable.

Outwardly telescoped by the liner 50 and a portion thereof by the reinforcing collar 44 is a bearing sleeve 74 which partially outwardly surrounds the screw stems 56. The bearing sleeve 74 surrounds a portion of the cylinder retaining sleeve 62 and forms the bearing for such cylinder retaining sleeve. A torque housing 76 and a torque spring 78 are received over the inner end of the cylinder retaining sleeve 62, the inner end of the cylinder retaining sleeve 62 being turned radially outwardly to complete the housing for the torque spring.

Inwardly of the cylinder retaining sleeve 62 over an inner portion thereof is a half-round spindle 80. The half-round spindle 80 is of a generally usual type extending slightly over halfway into the door 34 for acting in the usual manner with the latch driving mechanism 36. Further, the half-round spindle 80 has a leg 82 bent outwardly into interference with the cylinder retaining sleeve 62 and the cylinder retaining sleeve has spaced impressions 84 to extend inwardly and grip the edges of the half-round spindle. A stop spacer 86 serves to form the separate outer edges for the half-round spindle 80 and radially inwardly also forms the outer edges for the cam 88 having the locking slide 90 thereon.

The cam 88 moves rotatably a given distance, while the locking slide 90 moves in and out on a set axial line, guided by a spring retainer 92 and a compression spring 94. As can be seen particularly well in FIGS. 7 and 14, the cam has a cam surface 96 which provides the movement for the locking slide 90 inwardly and outwardly and movement of engagement arm 98 of the locking slide 90 inwardly and outwardly to disengage from or engage with one of the engagement notches 72 of the knob collar 70. It will be noted that the engagement arm 98 of the locking slide 90 projects radially through the cylinder retaining sleeve 62 and into engagement or disengagement with the knob collar 70 of the exterior knob 66. It will also be noted that when the locking slide 90 is withdrawn inwardly out of engagement, the engagement arm 98 thereof is received in a pocket 100 formed in the bearing sleeve 74, the pocket being particularly seen in FIGS. 7 and 13.

Sufficient for the freely rotatable knob construction of the present invention, the lock assembly 64 includes a lock cylinder 102 having a usual chimney 104 projecting upwardly through a slot 106 of the cylinder retaining sleeve 62 and telescopeing a lock plug 108 which projects slightly inwardly of the lock cylinder as is shown. The lock cylinder and plug 102 and 108 are held in position relative to each other and are secured within the cylinder retaining sleeve 62 by a retaining collar 110 which is retained against axial movement by engagement in a retaining slot 162 of the lock plug 108 against the inner edge of the lock cylinder 102 and behind a depression 112 formed outwardly within the cylinder retaining sleeve 62, also as seen. With a usual key and the lock assembly 64 being of the usual pin type, the lock plug 108 may be rotated within the lock cylinder 102 in the usual manner.

Figure 8:
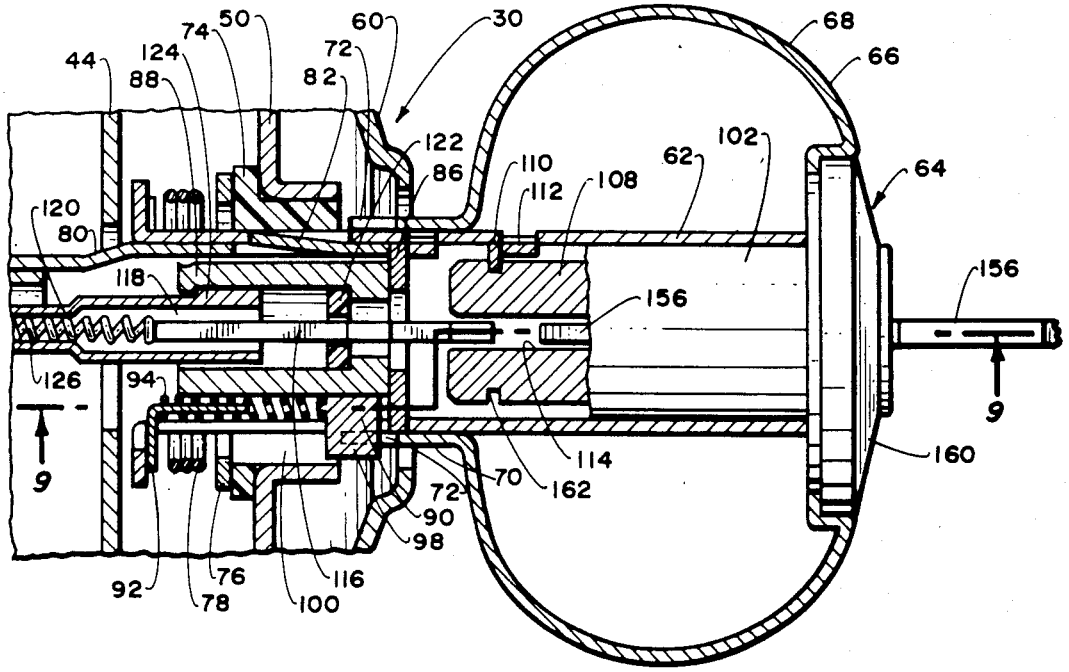
FIG. 8 is a view similar to FIG. 1, but only the showing of the right-hand or exterior knob of the assembly unlocked and enlarged for illustrating primarily the free knob rotation construction.
Figure 9:
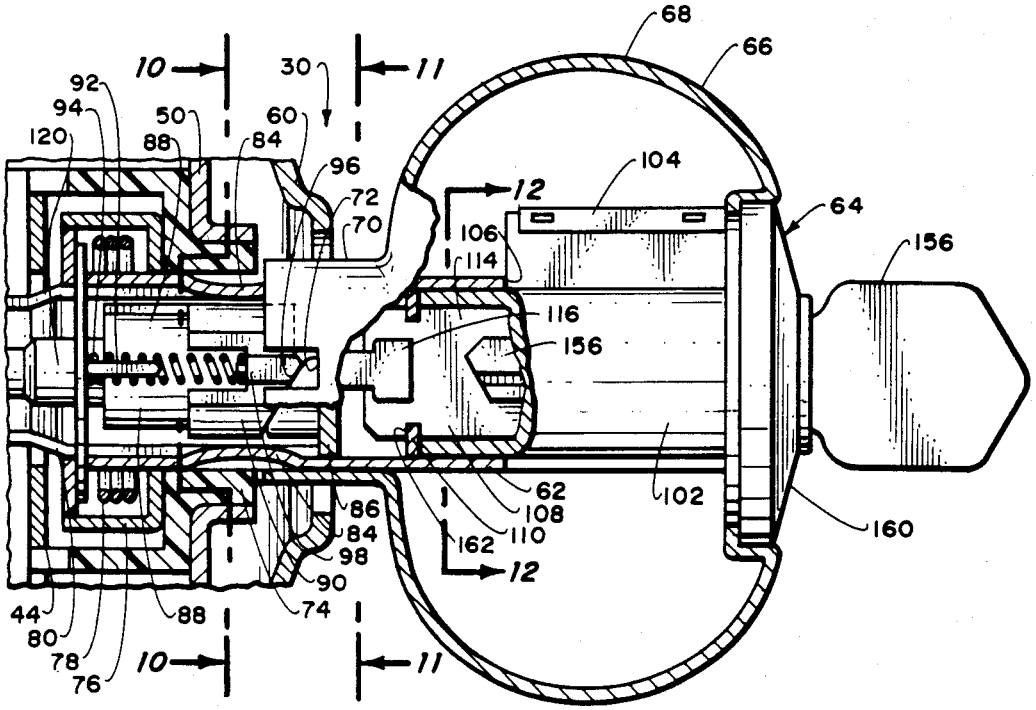
FIG. 9 is a sectional view looking in the direction of the arrows 9—9 in FIG. 8, the knob assembly still unlocked.
Figure 10:
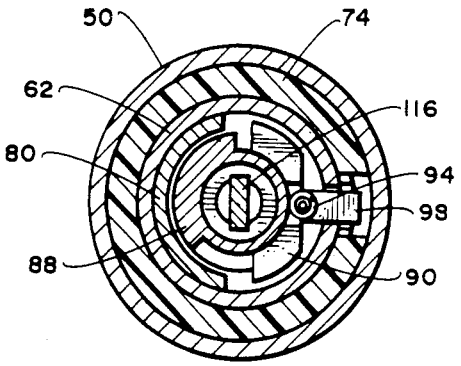
FIG. 10 is a sectional view looking in the direction of the arrows 10—10 in FIG. 9.
Figure 11:
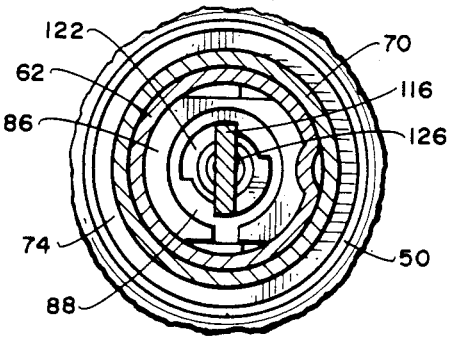
FIG. 11 is a sectional view looking in the direction of the arrows 11—11 in FIG. 9.
Figure 12:
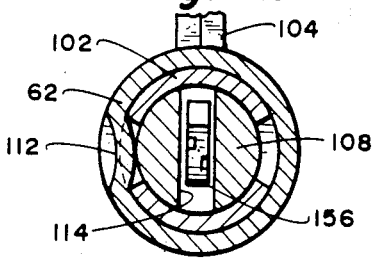
FIG. 12 is a sectional view looking in the direction of the arrows 12—12 in FIG. 9.
Figure 13:
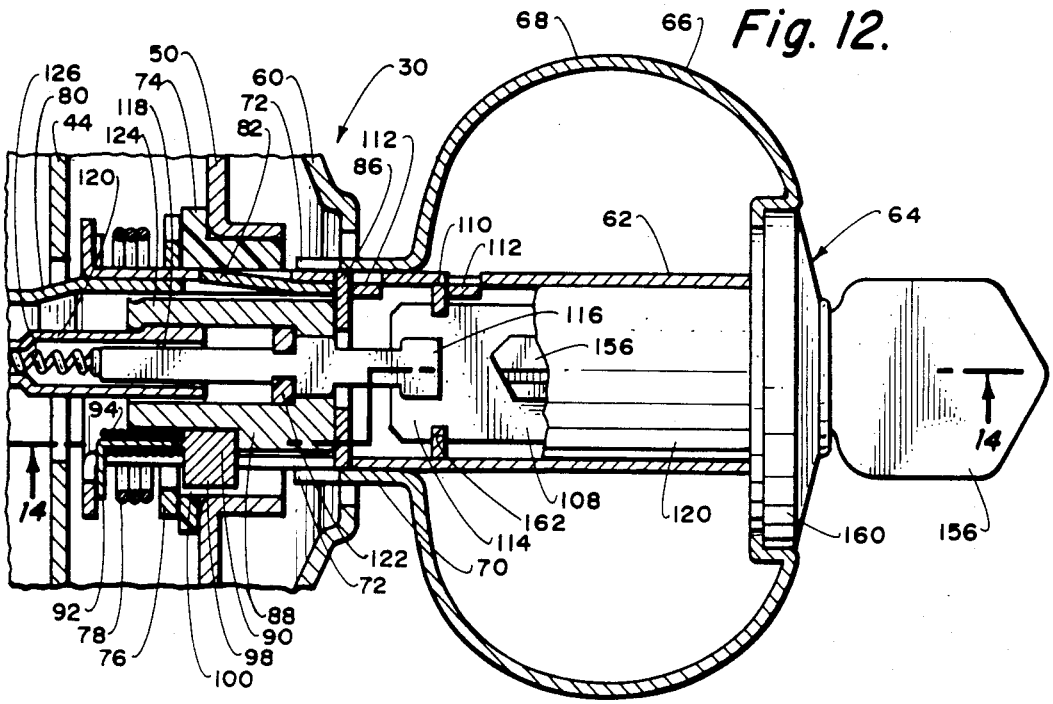
FIG. 13 is a view similar to FIG. 8 but with the lock plug turned 90 degrees in the lock cylinder placing the free knob rotation in the locked position with the knob free to rotate.
Figure 14:
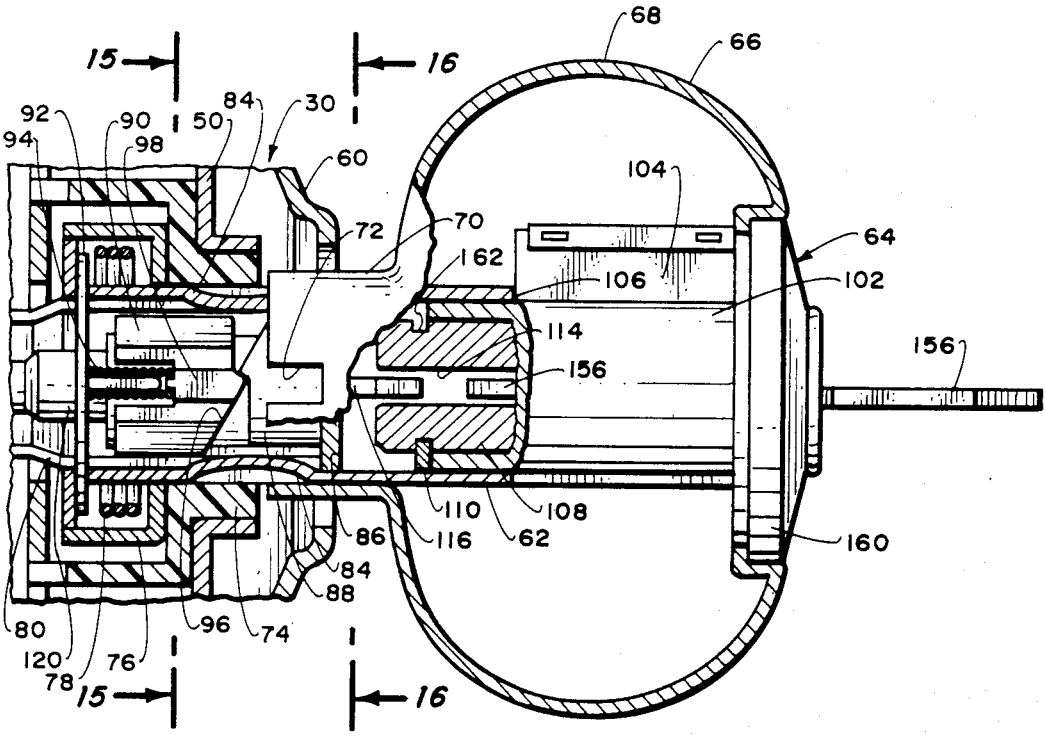
FIG. 14 is a sectional view looking in the direction of the arrows 14—14 in FIG. 13.
Figure 15:
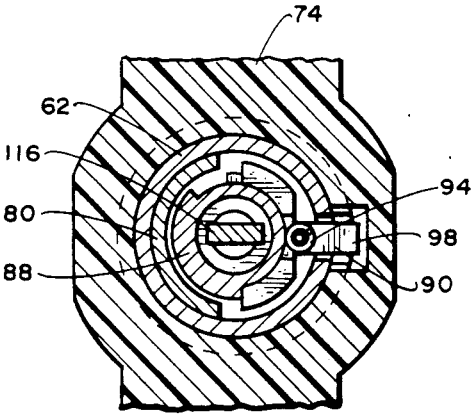
FIG. 15 is a sectional view looking in the direction of the arrows 15—15 in FIG. 14.
Figure 16:
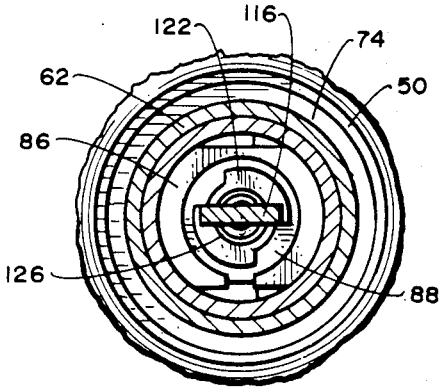
FIG. 16 is a sectional view looking in the direction of the arrows 16—16 in FIG. 14.

The lock plug 108 opens inwardly with a torque slot 114 which receives the outer end of a torque blade 116, the inner end of which is received in an outer opening 118 of a switching spindle 120. As is clearly seen, for instance, in FIGS. 8, 10, 11 and 13, the torque blade 116 passes from the lock plug 108, through the stop spacer 86 and telescopically through the cam 88. Partially through the cam 88, the torque blade 116 is supported by a bearing ring 122 at a reduced diameter so that the bearing ring within the cam 88 forms the forward limit for movement of the torque blade 116. The outer end of the switching spindle 120 has a notch 124, as shown in FIGS. 8 and 13, with this end portion of the switching spindle being received in the cam 88 while in turn telescoping the end of the torque blade 116. The cam 88 is formed downwardly over the switching spindle notch 124 to retain that assembly and a compression spring 126 is positioned within the outer opening 118 of the switching spindle 120 bearing against the inner termination of the torque blade 116.

Figure 2:
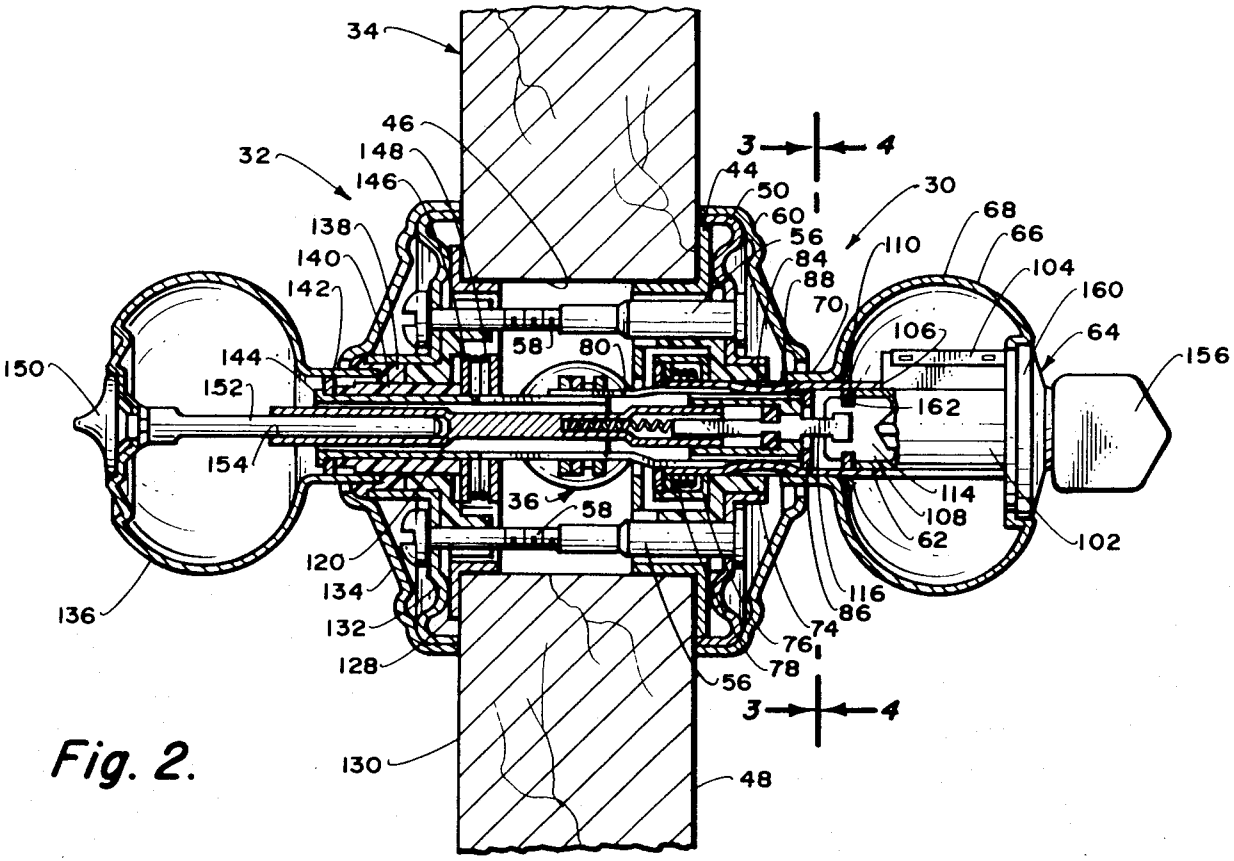
FIG. 2 is a vertical sectional view of the knob assembly of FIG. 1 and looking in the direction of the arrows 2—2 in FIG. 1.
Figure 3:
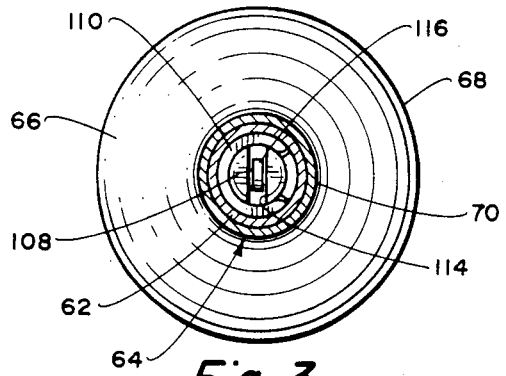
FIG. 3 is a vertical sectional view looking in the direction of the arrows 3—3 in FIG. 2.
Figure 4:
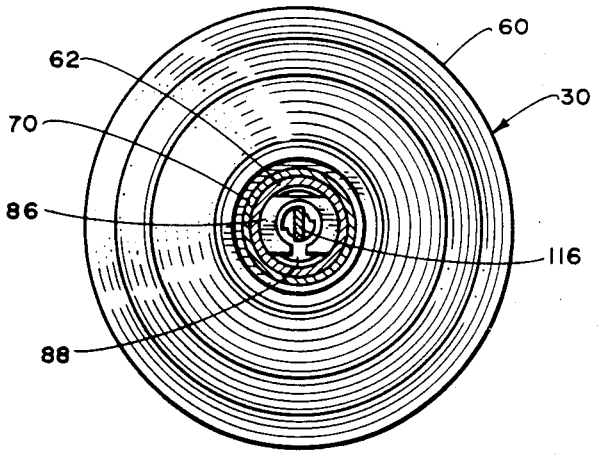
FIG. 4 is a vertical sectional view looking in the direction of the arrows 4—4 in FIG. 2.
Figure 5:
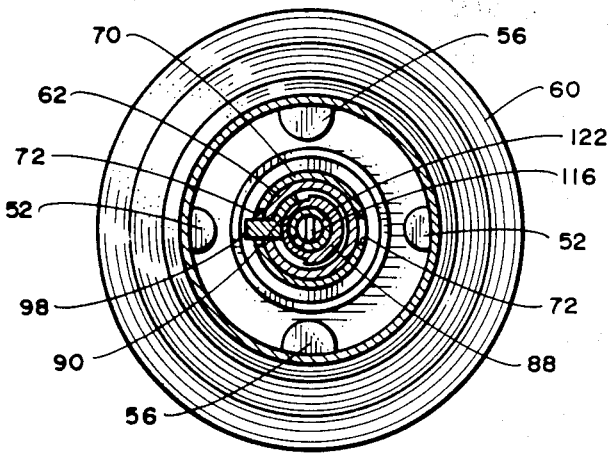
FIG. 5 is a vertical sectional view looking in the direction of the arrows 5—5 in FIG. 1.
Figure 6:
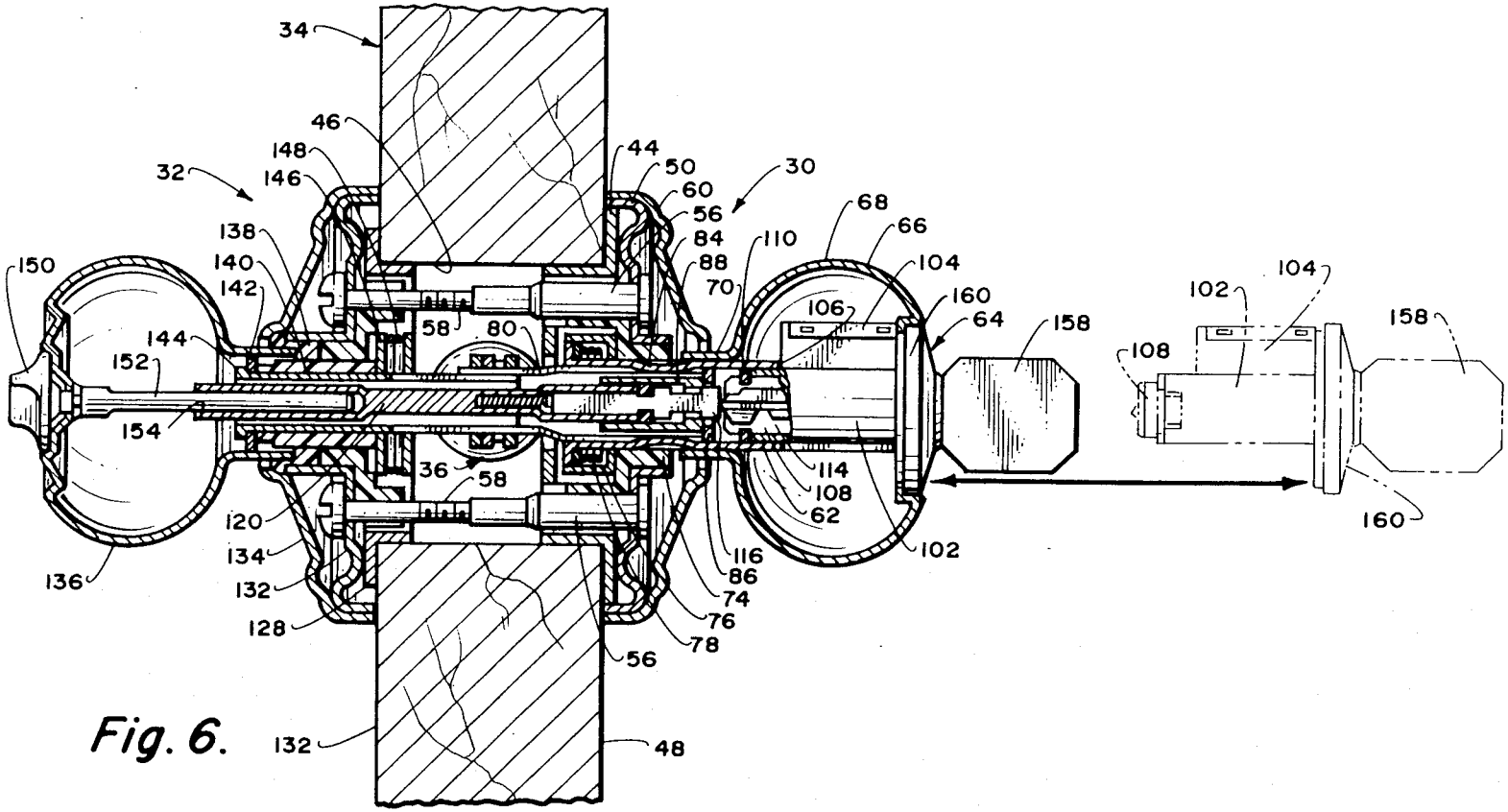
FIG. 6 is a view similar to FIG. 1, but with a cylinder removal key in place and the lock plug rotated 180 degrees in the lock cylinder and ready for removal or just after insertion of a unitary lock cylinder and plug, a unitary lock cylinder and plug also being shown in phantom lines to the right of the knob assembly.
Figure 7:
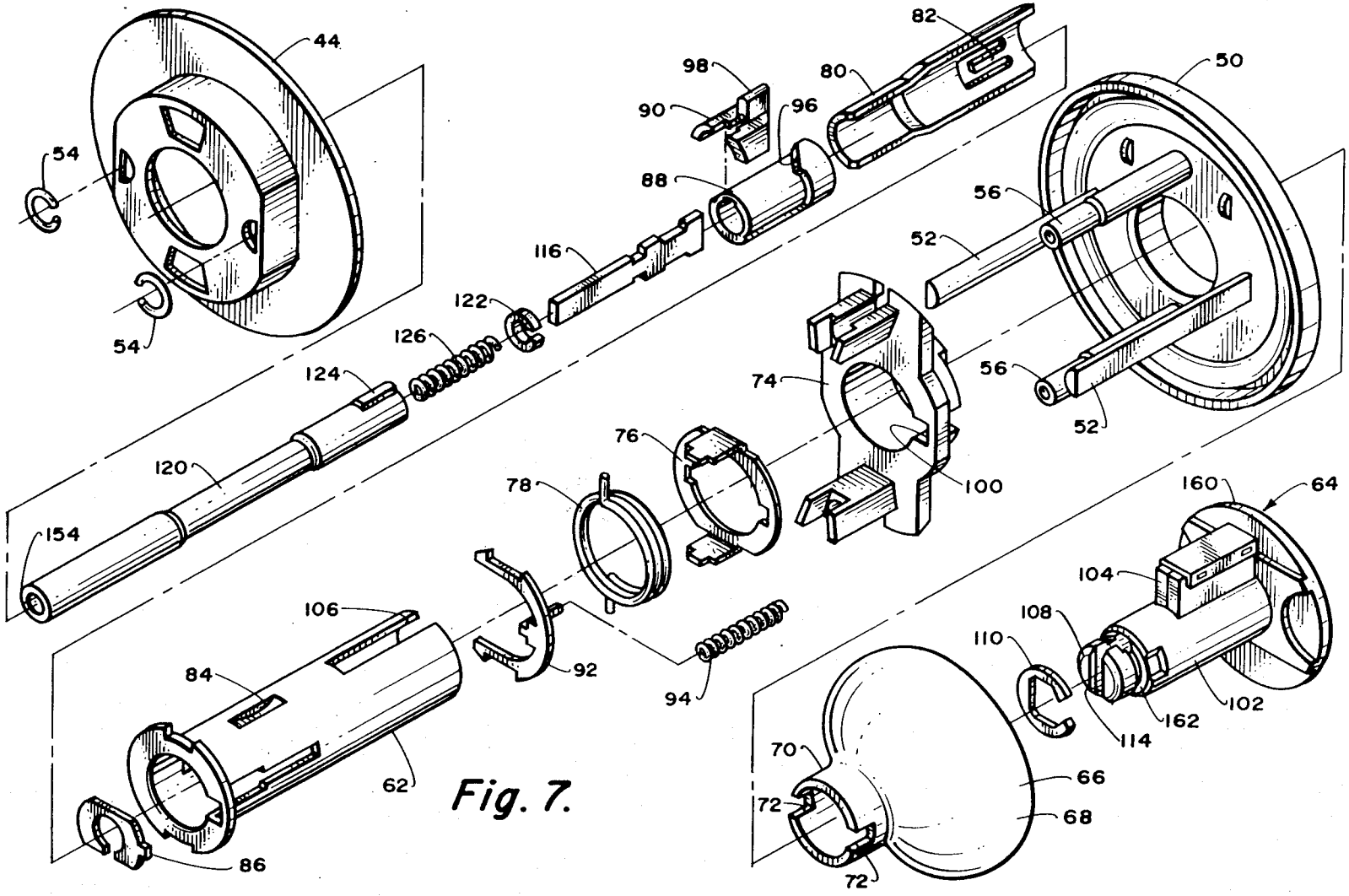
FIG. 7 is a disassembled perspective view of all of the right-hand side or exterior parts of the exterior knob assembly shown disassembled and in exploded view, the left-hand side or interior side and the latch driving mechanism and bolt being removed.

The interior or inner operating device 32, as specifically seen in FIGS. 1 and 2, includes a reinforcing collar 128 partially received in the door opening 46 and partially lying against a door inside face 130. A liner 132 telescopes over the reinforcing collar 128 and mounts the screws 58 which pass through the door 34 for engagement with the screw stems 56 as previously alluded to. Finally, a rosette 134 telescopes over the liner 132 to cover against the door inside face 130 and complete the inside assembly except for the interior or inner knob 136 and its particular mounting.

The interior or inner knob 136 is, in this embodiment, of usual form and is partially received inwardly through the rosette 134 and partially through the liner 132. It is mounted in a first bearing sleeve 138 telescoping a second bearing sleeve 140. The second bearing sleeve 140, in turn, mounts a washer 142 and a half-round spindle 144 which extends inwardly through the latch driving mechanism 36 directly inside the half-round spindle 80 of the exterior operating device 30. A torque housing 146 with a torque spring 148 telescopes the half-round spindle 144 and serve the usual function of urging the half-round spindle to neutral position.

A turn button 150 is rotatably mounted centrally of the interior knob 136 and has a stem 152 projecting inwardly. As shown, the stem 152 is telescoped by the inner opening 154 of the switching spindle 120. Thus, the turn button 150 through the switching spindle 120 may have operable effect on the freely rotatable knob construction at the exterior knob 66 as will be hereinafter discussed more in detail.

In operation of the freely rotatable knob construction of the present invention, the knob assembly is shown in an unlocked state in FIGS. 1 through 5 and 8 through 12. A normal key 156 is shown in the lock assembly 64, but it is not needed at this time for operating the latch driving mechanism 36 to operate the latch bolt and auxiliary deadbolt 38 and 40. Thus, the lock assembly 64 need not be actuated and the latch bolt and auxiliary deadbolt 38 and 40 may be withdrawn with the exterior knob 66 merely by turning the same.

As shown, particularly in FIGS. 8 through 12, a partial rotation of the exterior knob 66 transmits rotation into the engagement arm 98 of the locking slide 90 through engagement of the engagement arm 98 within one of the engagement notches 72 of the exterior knob 66. Movement of the locking slide 90 in turn, again, through the engagement arm 98 thereof transmits rotation into the half-round spindle 80. Movement of the half-round spindle 80 causes actuation of the latch driving mechanism 36 to move the latch bolt and auxiliary deadbolt 38 and 40 for withdrawing the same.

At the same time, if the latch bolt and auxiliary deadbolt 38 and 40 are to be withdrawn from an interior side of the door 34, as viewed in FIGS. 1 and 2, the interior knob 136 is rotated a partial turn. This transmits rotation from the interior knob 136 into the half-round spindle 144 and ultimately into the latch driving mechanism 36. The latch driving mechanism 36 then transmits the rotation to the latch bolt and auxiliary deadbolt 38 and 40 for withdrawing the same.

Now assume that it is desired to place the knob assembly in locked position, this can be done in two ways, by placing the lock assembly 64 in locked position or by placing the turn button 150 of the interior knob 136 in locked position. If it is done by the lock assembly 64 at the exterior knob 66, the key is inserted and the lock assembly 64 placed in locked position. If it is done with the turn button 150 at the interior knob 136, the turn button 150 is merely repositioned in a locked position by partial rotation.

Specifically, as viewed in FIGS. 8 through 16 and accomplishing the same by the lock assembly 64, the normal key 156 is inserted and turned a partial rotation. This turns the lock plug 108 relative to the lock cylinder 102 and causes the torque blade 116 to move the switching spindle 120. Rotation of the switching spindle 120 outwardly rotates the cam 88 which moves and repositions inwardly the locking slide 90 to withdraw any rotational connection between this locking slide and the exterior knob 66. The exterior knob 66, therefore, rotates freely, as well as the lock assembly 64 being in locked position.

This same locking and placing the exterior knob 66 in freely rotational position may also be accomplished from the turn button 150 on the interior knob 136. The turn button 160 may be turned from non-locking to locked position which transmits rotation through the switching spindle 120 to the cam 88 rotating this cam a partial turn to withdraw the locking slide 90. This, again, withdraws the locking slide 90 from its engagement with the exterior knob 66 so that the exterior knob is freely rotatable. Back to the unlocked position is accomplished merely by the opposite rotation of the turn button 150 at the interior knob 136.

Thus, with the exterior knob 66 including the lock assembly 64 and the interior knob 136 including the turn button 150, and with the latch bolt and auxiliary deadbolt 38 and 40 in their locked positions, the exterior lock assembly 64 and the position of the turn button 150 places these in locked position and the external knob 66 is freely rotatable. To place the elements in unlocked position, the lock assembly 64 in the exterior knob 66 may, with a key, be turned to unlocked position. This will turn the turn button 150 to unlocked position and engage the exterior knob 66 with the elements including the half-round spindle 80. This further will permit manipulation of the latch bolt and auxiliary deadbolt 38 and 40 to open the door 34. At the same time, from the interior, the movement from locked to unlocked position is merely turning the turn button 150, which thereby permits rotation of the interior knob 136 to rotate the half-round spindle 144 to withdraw the latch bolt and auxiliary deadbolt 38 and 40.

As hereinbefore briefly alluded to, the preferred embodiment of knob assembly including the free knob rotation construction just described is only one of various constructions making use of these same inventive principles. For instance, the exterior pin-type lock assembly 64 in the exterior knob 66 could be eliminated. In that case, the entire locking and non-locking would be controlled by the turn button 150 or some other similar device on the interior knob 136. Turning in one direction would place the exterior knob 66 in freely rotatable position so that the door 34 could not be opened from the exterior side, and movement of the turn button 150 to the opposite position would provide the exterior knob 66 fully engaged so that latch bolt and auxiliary deadbolt 38 and 40 would be withdrawn to open the door 34.

The exterior operating device 30 could have the same construction of exterior knob 66 capable of free rotation, the exterior knob including the pin-type lock assembly 64, but the interior knob 136 having a pin-type lock assembly similar to the exterior knob 66. In this case, the freely rotatable or solidly engaged exterior knob 66 could only be obtained by manipulation of one of the pin-type locks, that is, the exterior or interior. If the exterior lock assembly is eliminated and only the interior lock assembly is included, the manipulation of the exterior knob 66 to either freely rotatable or solidly engaged could only be accomplished at the interior knob having the pin-type lock. Thus, there are a variety of constructions all broadly satisfying the freely rotatable knob construction principles of the present invention.

Referring now to the front-end loading concept of the present invention, the same is shown particularly in FIGS. 6, 7 and 17 through 23. In the preferred embodiment, in most cases, the normal key 156 is removed and a special cylinder removal key 158 is inserted. Thus, in this case, internal access to the door 34 is not required and everything is accomplished from outwardly or exterior of the door.

Figure 17:
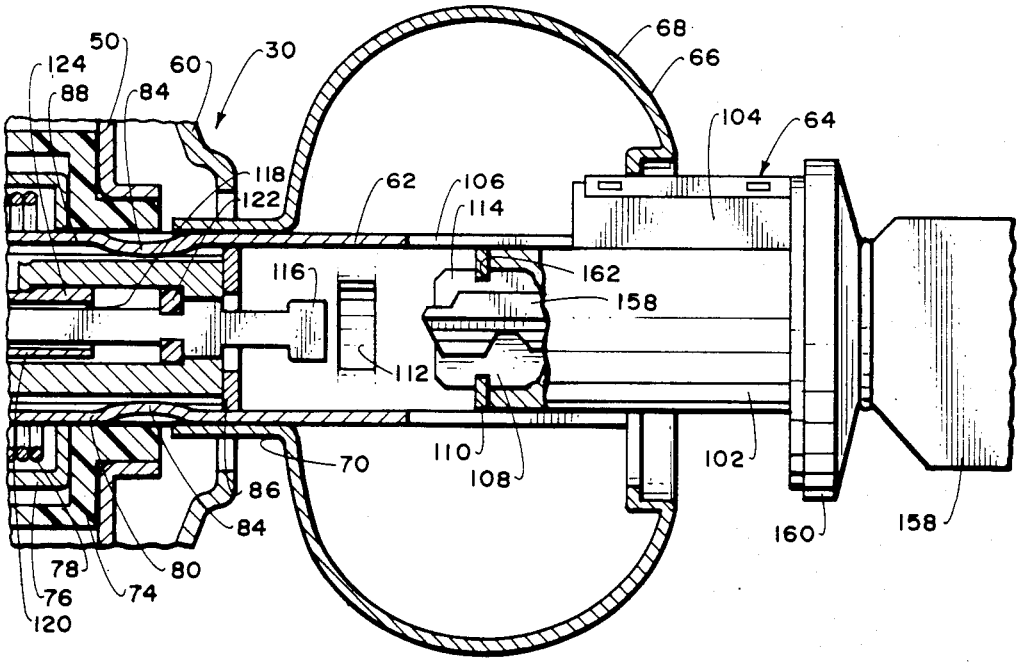
FIG. 17 is a view similar to FIG. 6, but showing only the right-hand or exterior knob with the lock plug rotated 180 degrees in the lock cylinder and the lock cylinder and plug entering using the special cylinder removal key.

Referring to FIG. 17, the lock assembly 64 is a unitary lock assembly wherein the lock cylinder 102, the lock plug 108 and the retaining collar 110 may be removed and replaced as a unit. The lock cylinder 102 has the chimney 104 including the front flange 160. The lock plug 108 is received in the lock cylinder 102 rotatable therewith and extending from the inner extremities of the cylinder. The retaining collar 110 is received over the inner end of the lock plug 108 in the retaining slot 162 thereof, thereby completing the unit.

Prior to insertion, the normal key 156, if present, would be removed and the cylinder removal key 158 would be inserted. You will note that the cylinder removal key 158 extends slightly further inwardly than the lock plug 108 as clearly shown. The lock plug 108 is rotated by the cylinder removal key 158 180 degrees from normal and as you will clearly see, for instance, in FIG. 20, the retaining collar 110 is movable with the lock plug 108 due to interfitting contours thereof.

Figure 18:
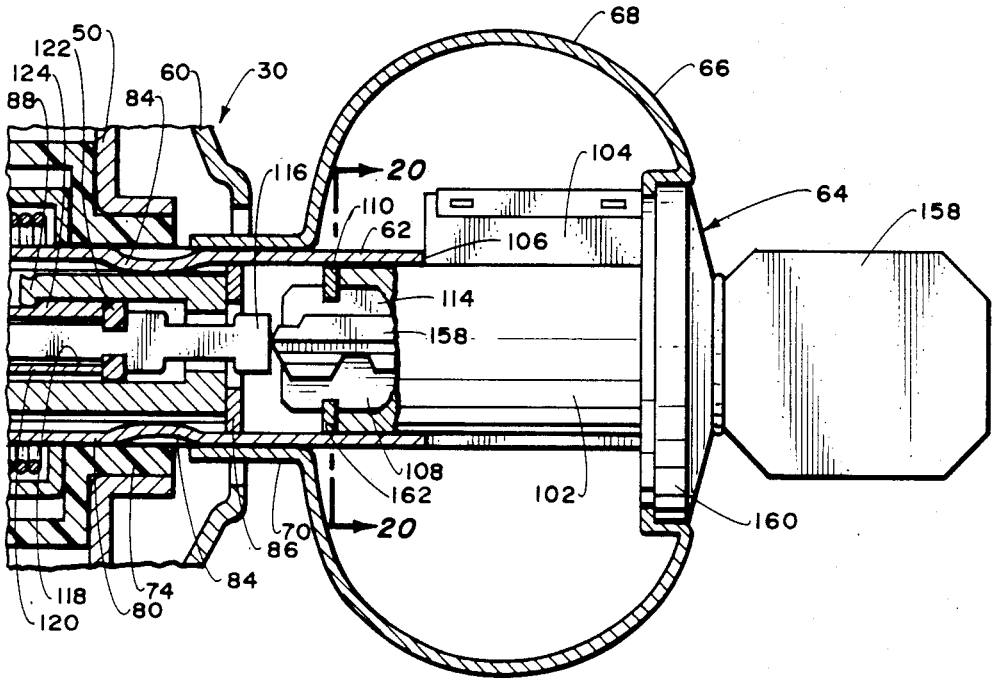
FIG. 18 is a view similar to FIG. 17, but with the lock cylinder and plug fully entered and the special cylinder removal key acting on the torque blade.
Figure 20:
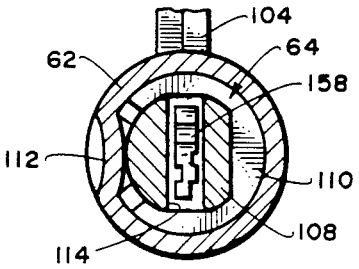
FIG. 20 is a sectional view looking in the direction of the arrows 20—20 in FIG. 18.

The unitary lock assembly 64 is now fully inserted within the cylinder retaining sleeve 62 and fully with the front flange 160 of the lock cylinder 102 tightly against the exterior knob 66, that is, from the position of FIG. 17 to the position of FIG. 18. You will note that the depression 112 extending inwardly from the cylinder retaining sleeve 62 is covered received in the slot 162 so that the retaining collar 110 is just inwardly beyond the depression 112. As can be seen in FIG. 20, the retaining collar 110 is C-shaped having a recess permitting the depression 112 of the cylinder retaining sleeve 62 to pass axially therethrough and assume the position within the slot 162 of the cylinder retaining sleeve 62. Keep in mind that the lock plug 108 is still rotated 180 degrees from normal and equally important, as the unitary lock assembly 64 is fully received in the cylinder retaining sleeve 62, the end of the cylinder removal key 158 engages the end of the torque blade 116 forcing it away from the lock plug 108, along with its bearing ring 122.

Figure 19:
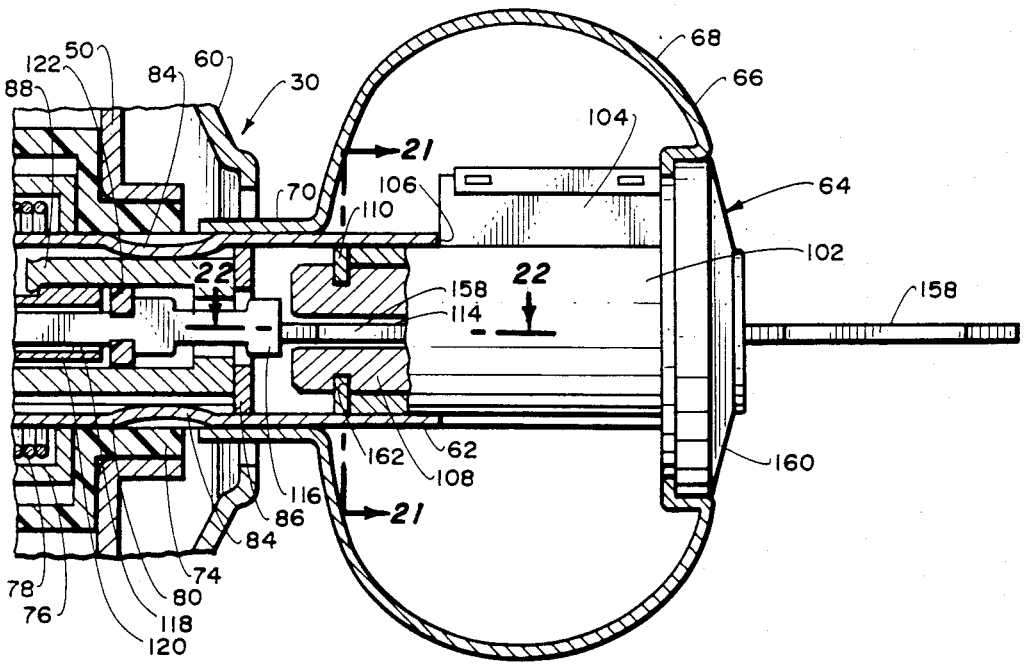
FIG. 19 is a view similar to FIG. 18, but with the special enlarged cylinder removal key turned 90 degrees from FIG. 18.
Figure 21:
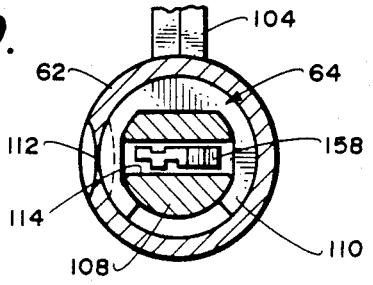
FIG. 21 is a sectional view looking in the direction of the arrows 21—21 in FIG. 19.
Figure 22:
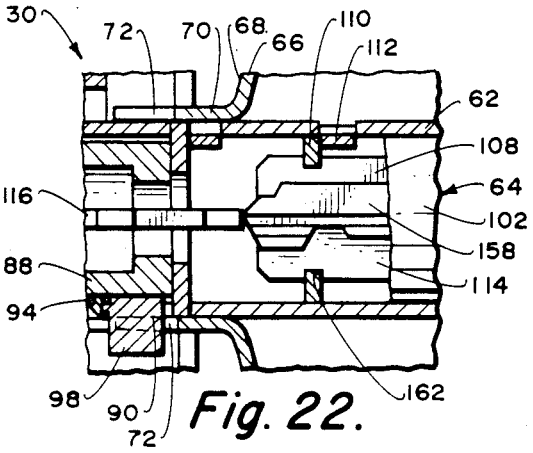
FIG. 22 is a sectional view looking in the direction of the arrows 22—22 in FIG. 19.
Figure 23:
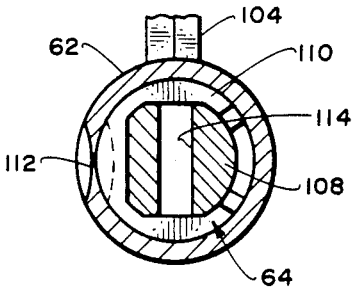
FIG. 23 is a view similar to FIG. 21, but with the lock plug rotated 180 degrees to place the front end loading lock construction in fully operable position.

The lock plug 108 by the cylinder removal key 158 is then rotated 180 degrees back to normal while the torque blade 116 is retained away from the lock plug 108 by the long cylinder removal key 158. FIGS. 19 and 22 show the lock plug 108 rotated a partial 90 degrees and, of course, the lock cylinder 102 remains stationary within the cylinder retaining sleeve 62 and its interfitting relationship therewith. More important, the retaining collar 110 relationship with the depression 112 of the cylinder retaining sleeve 62 is shown from insertion to 180 degrees rotation in FIGS. 20, 21 and 23. In FIG. 20, the unitary lock assembly 64 has just been inserted with the lock plug 108 turned the 180 degrees. In FIG. 21, the lock plug 108 has been turned by the cylinder removal key 158 a total of 90 degrees and it is seen that the retaining collar 110 has engaged behind the depression 112 of the cylinder retaining sleeve 62. Finally, FIG. 23 shows a rotation back the full 180 degrees ready for a proper key.

The cylinder removal key 158 is removed and if desirable, could be replaced by the normal key 156. In any event, when the cylinder removal key 158 is removed, the torque blade 116 is forced outward by the compression spring 126 within the switching spindle 120. Thus, the torque blade 116 reengages with the end of the lock plug 108 and is ready for operation. Furthermore, removal of the unitary lock assembly 64 is exactly opposite of the foregoing procedure.

In the event that a cylinder removal key 158 is not available and it is still desirable to insert or remove different locks of the unitary lock assembly 64, in the present embodiment shown, this can be done by using the switching spindle 120 at the interior knob 136. The switching spindle 120 is grasped and pulled from the interior side after removal of the turn button 150 and its stem 152 which moves the switching spindle 120 and ultimately the torque blade 116 toward the interior knob 136 until the torque blade is removed totally from the lock plug 108. Thereafter, the procedure is identically the same, keeping in mind that the torque blade 116 must be retained throughout the procedure of inserting or removing the particular unitary lock assembly 64. As far as other embodiments of the present invention are concerned, it will depend on the particular embodiment as to which procedure would be used, a simple guideline, it depends on what element is accessible for removing and retaining the torque blade 116.

Although the principles of the present invention, whether the freely rotatable knob construction or the front end loading of the lock, have been herein illustrated in a particular embodiment of knob assembly for doorlatches, it is not intended to limit such principles to that construction alone, since the same principles are readily applicable to various other forms of knob assembly for doorlatches. Thus, the principles of the present invention should be broadly construed and not limited beyond the specific limitations set forth in the appended claims including the patent equivalents thereof.

We claim:

1. In a latch construction of the type for mounting in doors and the like having a latch mechanism mounted within the door operably connected to at least an exterior operator retracted positions projecting from a door edge; the improvements including: said lock being of the type unitarily insertable for use axially into and removable for replacement from said exterior operator; said lock having a cylinder rotatably mounting a plug; securement means on said lock axially inward of said cylinder axially abutting said cylinder and rotatable exactly with said plug, said securement means preventing outward axial movement of said plug relative to said cylinder, said plug and securement means being rotatable between a lock non-secured position and a lock secured position; engagement means on said exterior operator disengaged from said securement means when said securement means is in said non-secured position and outwardly axially engaged with said securement means holding said lock in operable position when said securement means is engaged with said engagement means and moved to said lock secured position; a key in said lock plug turnable to certain positions for rotating said plug to rotate said securement means said securement means comprising a C-shaped retaining collar with an opening therein secured on said lock plug at an inner end of said cylinder rotatable with said lock plug for movement between said lock non-secured and lock secured position; and in which said lock cylinder has a recess formed therein opening outwardly at said lock cylinder inner end, said C-shaped retaining collar having said opening movable with said lock plug to said recess in said lock non-secured position and away from said recess to said lock secured position.

2. In a latch construction as defined in claim 1 in which spindle means is operable connected to said lock plug from axially inward of said lock plug when said securement means is in said lock secured position; and in which spindle disengagement means is operable to disengage said spindle means from said lock plug during movement of said securement means to and from said lock non-secured position.

3. In a latch construction as defined in claim 1 in which said key is a special lock changing key of increased axial length insertable in said lock plug when said securement means is in said lock secured position and throughout said movement of said securement means to said lock non-secured position and back to said lock secured position; and in which spindle means is normally engaged with said lock plug from axially inward of said lock plug when said securement means is in said lock secured position, said spindle means being engaged by said special lock changing key when said special lock changing key is inserted into said lock plug retaining said spindle means temporarily disengaged from said lock plug and during movement of said securement means to and from said lock non-secured position from said lock secured position.

4. In a latch construction as defined in claim 1 in which said engagement means comprises a sleeve secured in said exterior operator normally telescoping said lock and being disengageable from said securement means when said securement means is in said non-secured position and secured with said securement means when said securement means is in said lock secured position.

5. In a latch construction as defined in claim 2 in which said engagement means comprises a sleeve secured in said exterior operator normally telescoping said lock and being disengageable from said securement means when said securement means is in said non-secured position and secured with said securement means when said securement means is in said lock secured position.

6. In a latch construction as defined in claim 3 in which said engagement means comprises a sleeve secured in said exterior operator normally telescoping said lock and being disengageable from said securement means when said securement means is in said non-secured position and secured with said securement means when said securement means is in said lock secured position.

* * * * *

UNITED STATES PATENT AND TRADEMARK OFFICE

CERTIFICATE OF CORRECTION

PATENT NO. : 4,672,829

DATED : June 16, 1987

INVENTOR(S) : Gater et al.

It is certified that error appears in the above-identified patent and that said Letters Patent is hereby corrected as shown below:

Claim 1, line 4 after the word "operator", the following should be inserted -- controlled by a lock for driving a latchbolt between extended and --.

Signed and Sealed this

Twenty-second Day of December, 1987

*Attest:*

DONALD J. QUIGG

*Attesting Officer*

*Commissioner of Patents and Trademarks*